US005832684A

United States Patent [19]

Trout et al.

[11] Patent Number: 5,832,684

[45] Date of Patent: Nov. 10, 1998

[54] BUTT JOINT HANGER FOR DRYWALL CONSTRUCTION

[76] Inventors: Willis Z. Trout; Darrick S. Trout, both of 1124 Siddonsburg Rd., Mechanicsburg, Pa. 17055

[21] Appl. No.: 679,908

[22] Filed: Jul. 15, 1996

[51] Int. Cl.[6] ..... E04B 2/74

[52] U.S. Cl. ..... 52/417; 52/416; 52/514.5; 52/747.1

[58] Field of Search ..... 52/416, 417, 418, 52/514, 514.5, 747.1

[56] References Cited

U.S. PATENT DOCUMENTS

| | | | |
|---|---|---|---|
| 2,736,929 | 3/1956 | Nies et al. . | |
| 3,455,077 | 7/1969 | Long | 52/417 X |
| 3,675,383 | 7/1972 | Paoletti | 52/417 X |
| 4,237,669 | 12/1980 | Hunter . | |
| 4,392,336 | 7/1983 | Ganssle . | |
| 4,727,700 | 3/1988 | Eberle . | |

FOREIGN PATENT DOCUMENTS 1287947 of 1962 France .

*Primary Examiner*—Carl L. Friedman
*Assistant Examiner*—Timothy Kang
*Attorney, Agent, or Firm*—James M. Trygg

[57] ABSTRACT

A butt joint hanger (30) includes a central elongated rail (32) and two support elongated rails (34, 36) positioned on either side of the central rail (32). One or more U-channels (38) interconnect the three rails (32, 34, 36) at pivoting attachment points (40). The butt joint hanger (30) is inserted between two construction beams (94, 96) and the butt ends (108, 114) of two sheets of wallboard (104, 112) are attached to the central rail (32) by means of drywall screws (110). The two support rails (34, 36) abut against the surfaces of the wallboard flush with the nailing surfaces (98, 100) of the construction beams (94, 96) and the drywall screws (110) force the butt ends (108, 114) of the wallboard out of the plane (102) of the wallboard and into engagement with the central rail (32). This results in a depression area (116) adjacent both butt ends (108, 114) which can be easily filled with plaster (122) to produce a flat smooth butt joint (126).

27 Claims, 7 Drawing Sheets

Fig. 18
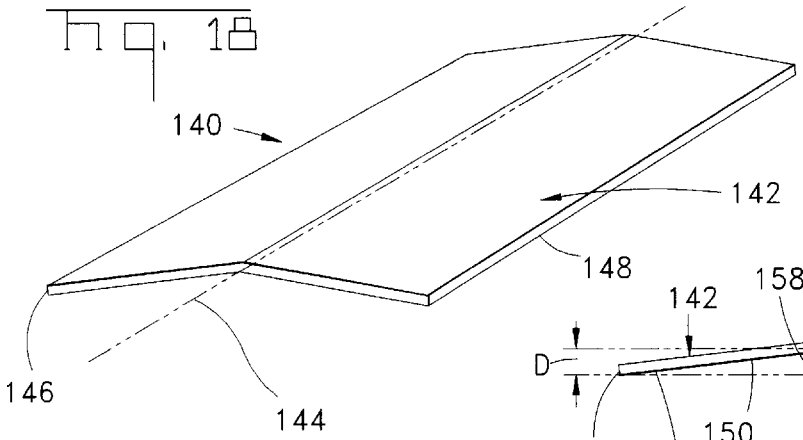
Fig. 19
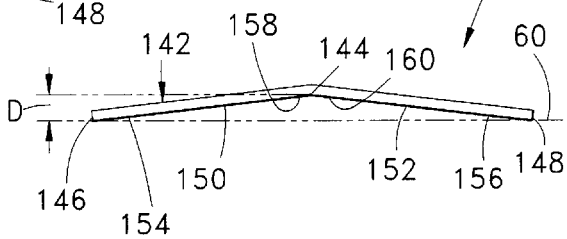
Fig. 20
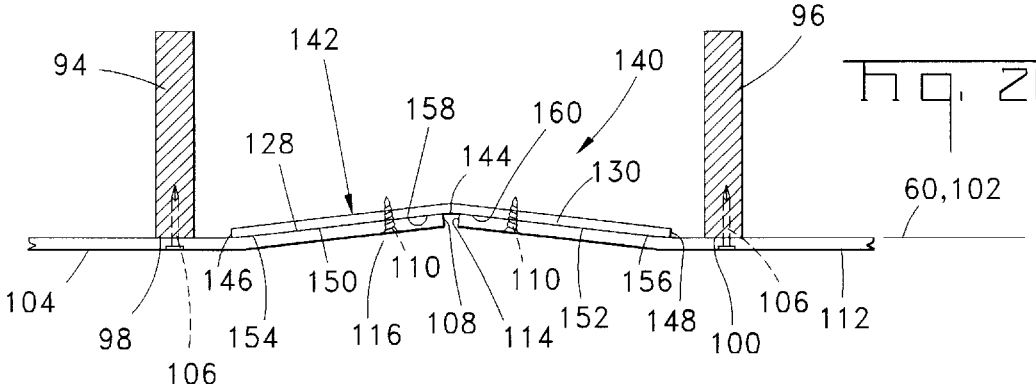
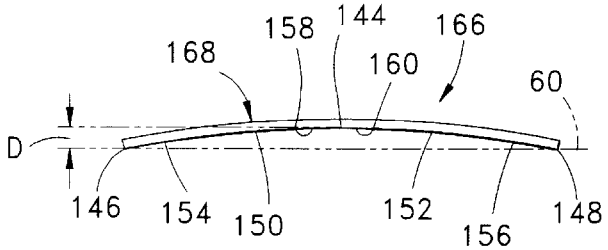
Fig. 21
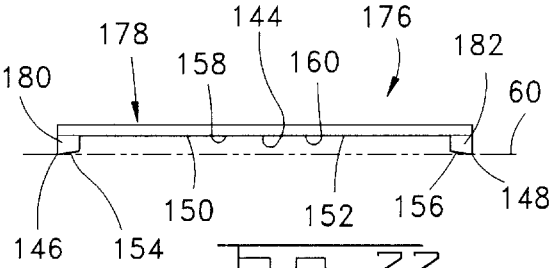
Fig. 22

BUTT JOINT HANGER FOR DRYWALL CONSTRUCTION

The present invention relates to drywall construction and more particularly to an improved butt joint support hanger for providing a smooth flat finished butt joint.

BACKGROUND OF THE INVENTION

In the construction of buildings, interior walls and ceilings typically consist of a layer of gypsum wallboard attached to construction beams which may be made of wood or other materials. The joining of adjacent edges of two pieces of wallboard is accomplished by the application of a plaster-like material to the joint with an embedded layer of paper tape to inhibit cracking of the finished joint. Usually the longer edges of the wallboard are pre-beveled to receive the plaster so that the finished joint is flat and smooth. However, the ends of the wallboard are not beveled. Additionally, when it is necessary to cut a portion of the wallboard away when fitting it into a smaller space, the pre-beveled edges are frequently removed. In such cases the finished joint necessarily bulges out of the plane of the wall and is unsightly. An example of such a structure is illustrated in FIG. 1 where the nonbeveled two adjacent edges of two pieces of wallboard 10 and 12 are positioned in alignment with the center of a wooden construction beam 14 and nailed in place with the nails 16. Several layers of plaster 18 and an embedded layer of paper tape 20 are applied to the area to form the butt joint. The plaster leaves a bulge 22 that extends away from the plane 24 of the wallboard, as shown. The plaster is feathered outwardly on either side of the joint for 8 to 10 inches or so to render the bulge less obvious. This requires a substantial amount of skill and experience and, more importantly, the finished joint is unsightly. This is especially apparent when a glossy finish is applied to the finished surface. In an effort to overcome this problem the edges of the two pieces of wallboard to be joined are positioned between two adjacent construction beams. Joint support devices that extend from one construction beam to the other are positioned at intervals along the butt joint and are spaced slightly away from the surface of the wallboard so that when the edges of the wallboard are attached to the support devices, the edges are pulled toward the support device and out of the plane of the wallboard. This provides a recessed area along the joint for receiving the plaster material in a manner similar to that of pre-beveled edges. Examples of such joint support devices are disclosed in U.S. Pat. Nos. 4,237,669 which issued Dec. 9, 1980 to Hunter and 4,392,336 which issued Jul. 12, 1983 to Ganssle. Both of these devices have metal structures that extend from one construction beam to the other and are attached to the outwardly facing edges of the beams so that when the wallboard is installed, portions of the support devices are necessarily sandwiched between the mounting surfaces of the beams and the surfaces of the wallboard. This causes two problems. Once the wallboard is held in place preparatory to nailing to the construction beams, the joint support devices are no longer visible, and since they are made of metal they may interfere when nailing the wallboard to the beams. The other problem is that the portion of the metal structures that are sandwiched between the mounting surfaces of the beams and the wallboard cause bulges in the wallboard and can damage the inner surface of the wallboard if, when nailing, a hammer blow inadvertently strikes the wallboard near an edge of the metal. Another problem associated with both of these devices is that they are spaced apart a substantial amount so that the two edges of the wallboard are not supported along their entire lengths. This causes the edges of the wallboard to scallop by bowing outwardly in the spaces between the supports, making it more difficult to apply the plaster material and obtain a smooth, flat butt joint. While it is good practice in the industry to glue these butt joint edges to the construction beam for the entire length of the butt joint, this cannot be done in this case. Further, because the joint support devices are made of metal, prior to attaching the edges of the wallboard to the support device, suitable holes must be drilled through the metal to receive the wallboard mounting screws, or self drilling and tapping screws must be used. This, of course, adds to the cost of producing the joint. Another example of a joint support device is disclosed in French Patent No. 1,287,947. Here, cleats are positioned between two adjacent construction beams and nailed in place. The cleats are spaced apart along the site of the butt joint with their wallboard mounting surfaces spaced a slight distance from the wallboard. The two edges of the two pieces of wallboard are then nailed to the cleats causing the edges to bend slightly inwardly out of the plane of the wallboard. Since the cleats are spaced apart a substantial amount so that the two edges of the wallboard are not supported along their entire lengths, as set forth above, the edges of the wallboard will scallop by bowing outwardly in the spaces between the supports, making it more difficult to apply the plaster material and obtain a smooth, flat butt joint. Again, there is no way to glue the edges of the butt joints along their entire lengths. Additionally, the cleats must be accurately cut to fit between the two construction beams, accurately spaced from the wallboard mounting surface, and then securely nailed to the beams, generally requiring the services of a carpenter. This additional work, of course, increases the cost of making the butt joint.

What is needed is a butt joint support device that is easily installed, by the wallboard installer, between two construction beams without cutting to size and does not require attachment to the beams in any way. Further, the device should not interfere with the normal attachment of the wallboard to the construction beams, yet should support the edges of the two pieces of wallboard and provide a glue base along the entire length of the butt joint. The device should have a wallboard mounting surface that is spaced a desired distance from the wallboard to provide the desired beveled effect and should require no drilling of holes during installation of the wallboard.

SUMMARY OF THE INVENTION

A butt joint hanger device adapted for use between two construction beams is provided for connecting adjacent ends of two pieces of wallboard together to form a butt joint having a first length. The hanger device includes first and second parallel elongated rails having opposite outer surfaces. The first and second rails are on opposite sides of a centerline so that the opposite outer surfaces are on a desired spacing. A central elongated rail having a second length and a longitudinal axes coincident with the centerline is disposed between the first and second rails. At least one lateral member is secured at attachment points to the first and second rails and to the central rail for holding the two opposite outer surfaces on the desired spacing. The first and second rails have first and second abutting surfaces, respectively, opposite the lateral members, each first and second abutting surface being adjacent a respective opposite outer surface. Opposite outer edges of the first and second abutting surfaces defining a plane. The central rail includes a mounting surface opposite the lateral members, the central member being spaced from the plane.

DESCRIPTION OF THE FIGURES

FIG. 9 is a view similar to a portion of FIG. 8 showing an alternative construction;

FIG. 18 is an isometric view showing a second embodiment of the butt hanger of the present invention;

FIG. 19 is a end view of the butt hanger shown in FIG. 18;

FIG. 20 is a view similar to that of FIG. 17 showing installation of the second embodiment butt hanger;

FIG. 21 is an end view similar to that of FIG. 19 showing a variation of the second embodiment butt hanger; and FIG. 22 is an end view similar to that of FIG. 19 showing another variation of the second embodiment butt hanger.

DESCRIPTION OF THE PREFERRED EMBODIMENT

Figure 2:
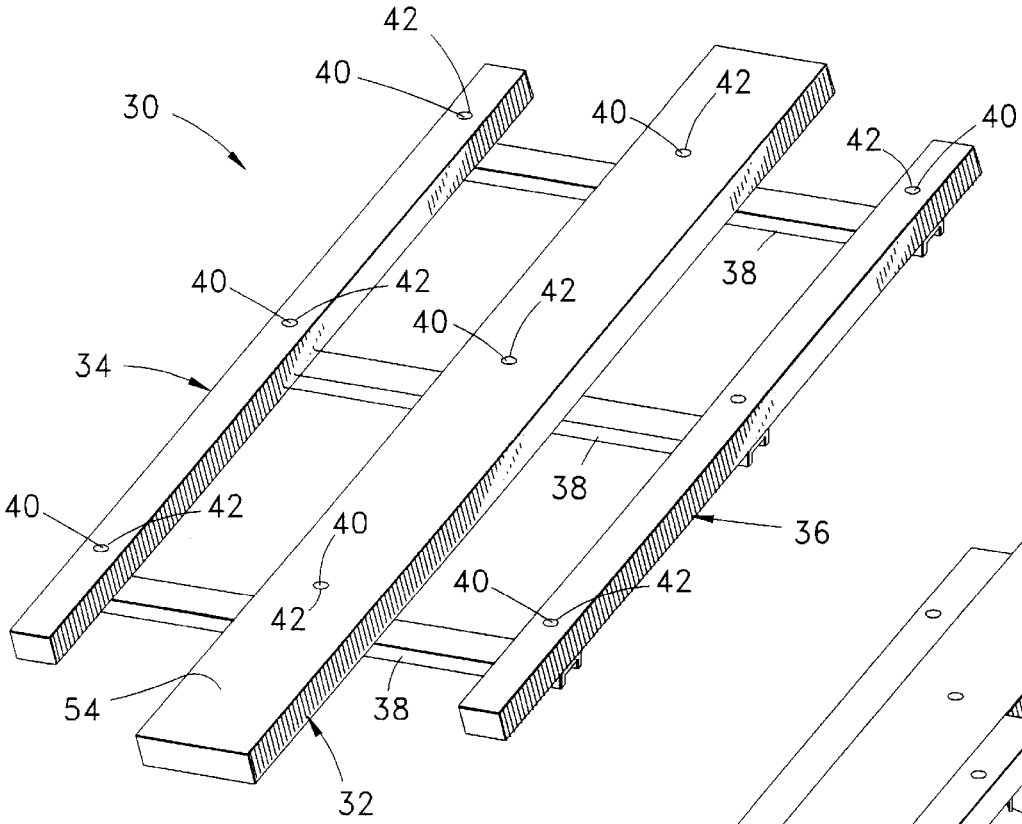
FIG. 2 is an isometric view of a butt joint hanger device incorporating the teachings of the present invention.
Figure 3:
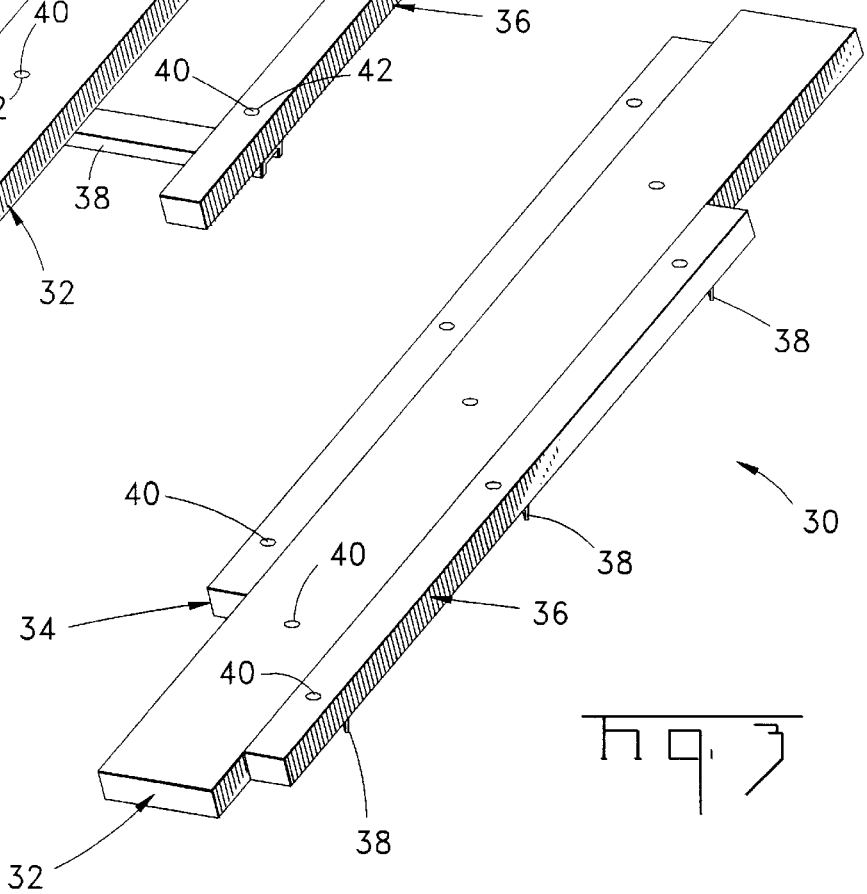
FIG. 3 is a view similar to that of FIG. 2 showing the butt joint hanger device in its closed position.
Figure 4:
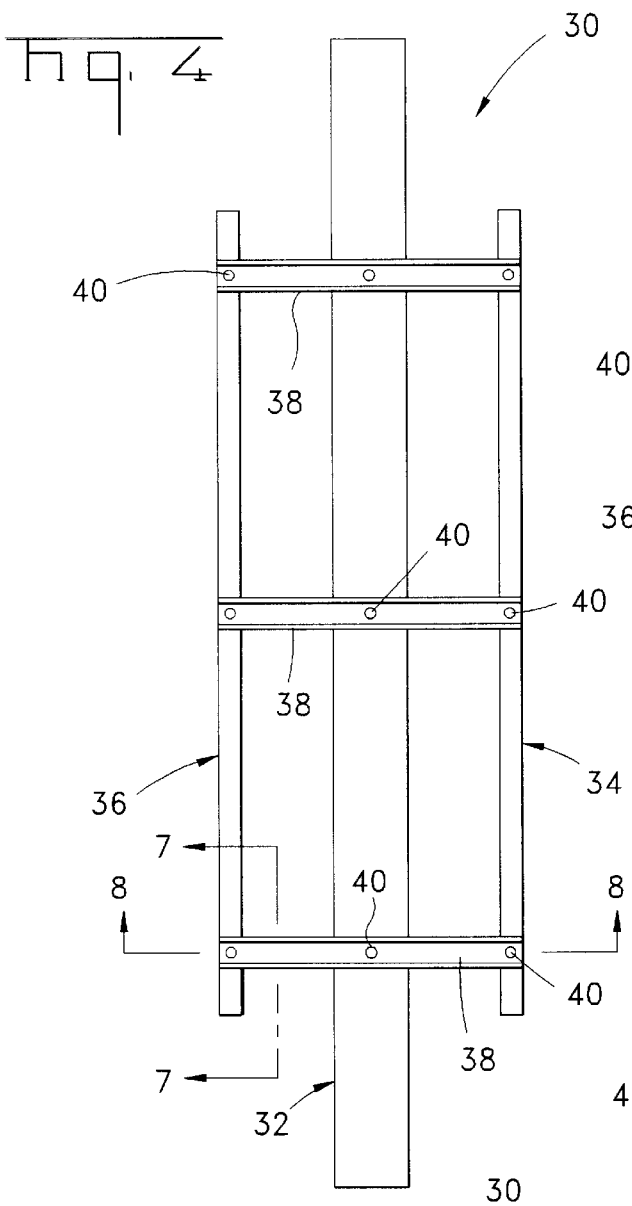
FIGS. 4 and 5 are plan and end views, respectively, of the butt joint hanger device shown in FIG. 2.
Figure 5:
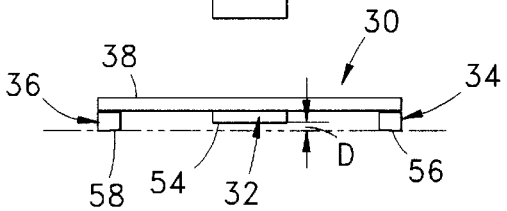

There is shown in FIGS. 2, 4, and 5 a butt joint hanger 30 including a central elongated rail 32 and first and second parallel elongated rails 34 and 36, respectively. The central rail 32 is made of wood or any other suitable material into which a fastener such as a wood screw or drywall screw may be screwed. The three rails are interconnected to three U-channel members 38 by means of screws 40 which extend through clearance holes in the three rails 32, 34, and 36 and are threaded into holes in the U-channels. The U-channels are made of metal and the screws 40 are self tapping, in the present example, however, they may be standard machine screws or other fasteners such as rivets or eyelets. It is important that the screws 40, or alternative fasteners, be sufficiently loose to allow pivoting of the three rails 32, 34, and 36 with respect to the U-channels 38 so that the butt joint hanger 30 can be collapsed to a closed position for storage and for shipping, as shown in FIG. 3. The length of the central rail 32 should be longer than the length of the butt joint with the central rail overlapping each end, if possible. When the butt joint is 48 inches long the central rail should be about 54 inches long and the first and second rails should be shorter, in the present example about 38 inches long so that when pivoted to their closed position they remain with the overall length of the central rail, as shown in FIG. 3.

Figure 8:
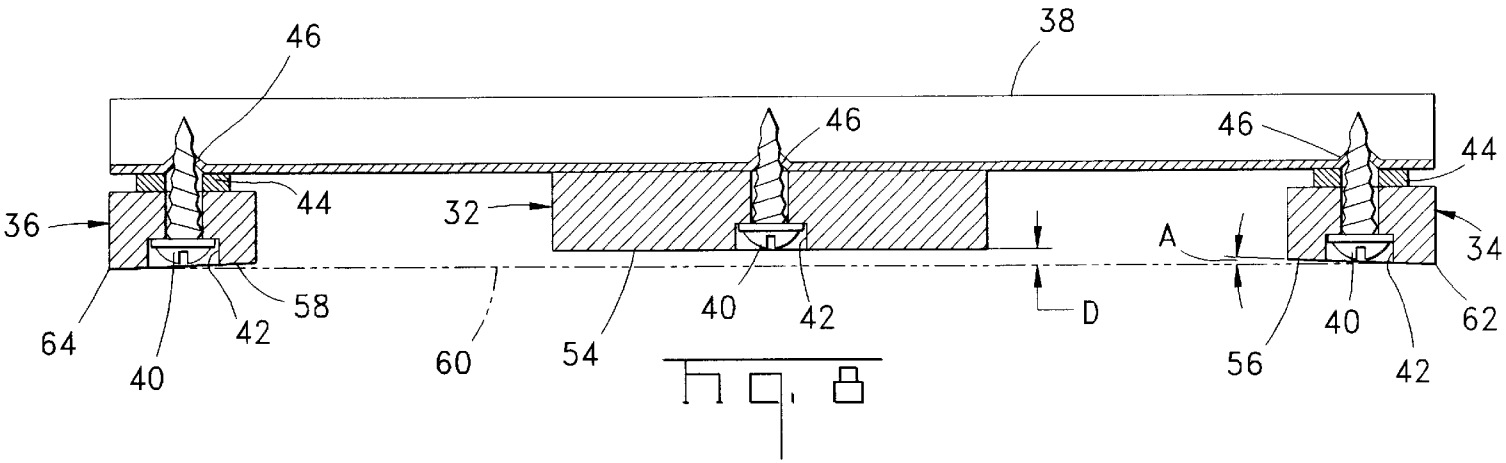
FIG. 8 is a cross-sectional view taken along the lines 8—8 in FIG. 4.
Figure 7:
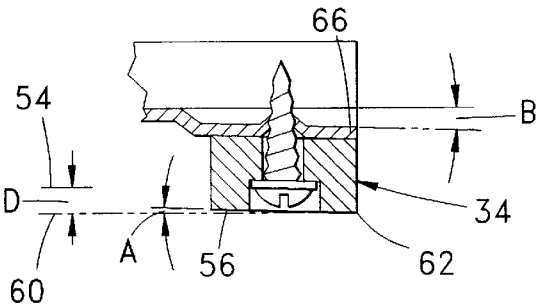
FIG. 7 is a cross-sectional view taken along the lines 7—7 in FIG. 4.
Figure 7:
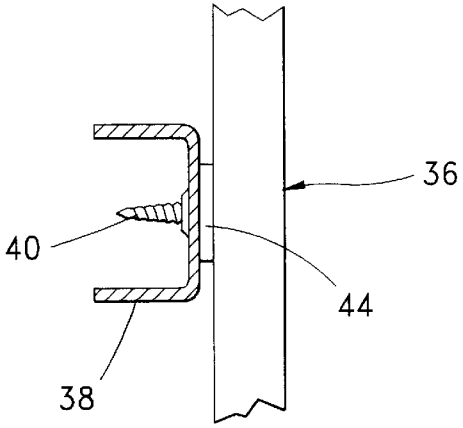

Each of the screws 40 is disposed in a counterbore 42 formed in its respective rail 32, 34, and 36, as shown in FIG. 8. A washer 44, or spacer, is disposed between the U-channel 38 and its respective rails 34 and 36 at each pivot point, as shown in FIGS. 7 and 8, for a purpose that will be explained. The screws 40 are tightened sufficiently to limit play between the parts yet will permit easy pivoting of the rails 32, 34, and 36 with respect to the U-channels from the open position shown in FIG. 2 to the closed position shown in FIG. 3. The U-channels 38 include dimples 46 at each pivot point to facilitate insertion of the screws 40 during assembly of the parts.

As best seen in FIGS. 5 and 8, the central rail 32 includes a flat mounting surface 54 opposite the U-channels 38 to which the wallboard is secured, as will be explained below. The first and second rails 34 and 36 include abutting surfaces 56 and 58, respectively, that are arranged to engage the surface of the wallboard facing the construction beams, as will be explained below. These abutting surfaces 56 and 58 define a plane 60 which is spaced from the mounting surface 54 of the central rail 32 by an amount, indicated at D in FIG. 8, that is equal to the thickness of the washers 44. This thickness, in the present example, is 0.120 inch, but may be between about 0.050 inch and about 0,120 inch. This, of course, is assuming that the thicknesses of the three rails 32, 34, and 36 are equal. If these thicknesses are not equal then the thickness of the washer should be adjusted to provide a distance D equal to about 0.120 inch. Although not necessary, in the present example the abutting surfaces 56 and 58 are tapered to diverge away from the plane 60 in the direction toward the central rail 32, as indicated by the angle A in FIG. 8, which is about 5 degrees or so. This results in the advantage that the wallboard will be flexed over a greater distance when installed thereby providing a smoother beveled area and lessening the chance of damage through cracking, as will be described further below. In this case the outside edges 62 and 64 of the first and second rails 34 and 36, respectively define the plane 60, as shown in FIG. 8. An alternative structure to the washers 44 is shown in FIG. 9. As shown, a boss 66 is formed in each end of the U-channel 38 extending downwardly a distance sufficient to provide the distance D between the plane 60 and the mounting surface 54. Additionally, the boss 66 is formed on an angle indicated at B in FIG. 9, the two angles A and B being equal. This has the advantage of allowing the use of first and second rails having parallel sides, that is, the abutting surfaces 56 and 58 need not be tapered.

Figure 10:
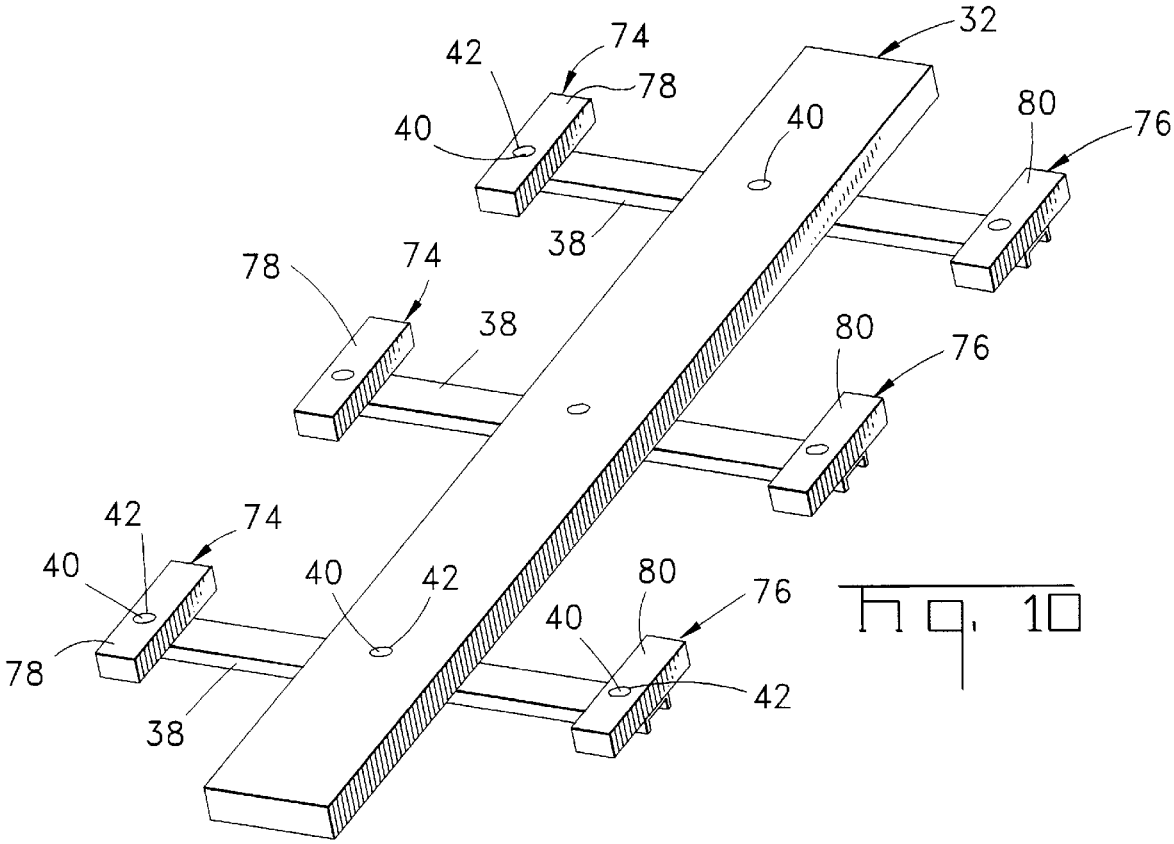
FIG. 10 is a view similar to that of FIG. 2 showing a second embodiment of the present invention.
Figure 11:
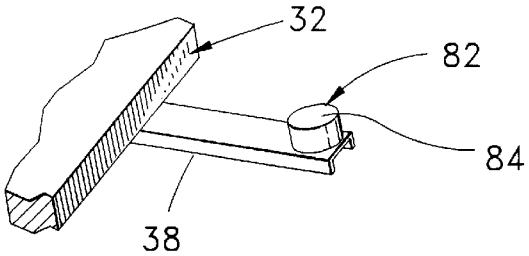
FIGS. 11 and 12 are views of a portion of the butt joint hanger device of FIG. 10 showing structural variations.
Figure 12:
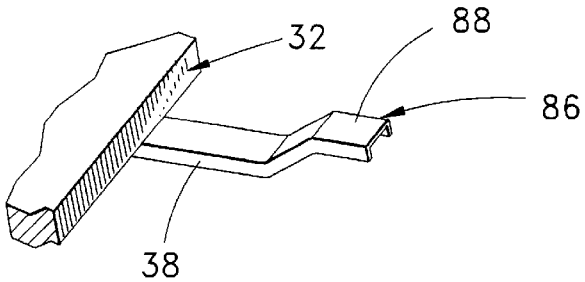

An alternative structure for the first and second elongated rails is shown in FIG. 10 where the first and second rails are replaced with relatively short segments 74 and 76, respectively. Each segment 74 and 76 includes abutting surfaces 78 and 80, respectively, and each has a similar cross section to that of the first and second rails 34 and 36, respectively, as shown in FIG. 8. The abutting surfaces 78 and 80 define the plane 60 in a manner similar to the abutting surfaces 56 and 58. The segments 74 and 76 are pivotally attached to the U-channels 38 in a manner similar to that of the first and second rails 34 and 36. A second alternative structure for the first and second elongated rails is shown in FIG. 11 where the first and second rails are replaced with a standoff 82 that is attached to each of the ends of the U-channels by any suitable means, such as the screws 40 or other fastening means. Each standoff 82 includes an abutting surface 84, the abutting surfaces 84 defining the plane 60. A third alternative structure for the first and second elongated rails is shown in FIG. 12 where the ends of each of the U-channels is formed to provide an offset portion 86 having an abutting surface 88. The abutting surfaces 88 of all of the U-channels define the plane 60 in a manner similar to that of the abutting surfaces 56 and 58. It will be understood that the actual shape and form of the standoff 82 and offset portion 86, and their associated abutting surfaces may vary provided that the distance D between the plane 60 and the mounting surface 54 is maintained at between about 0.050 inch and about 0.120 inch.

Figure 1:
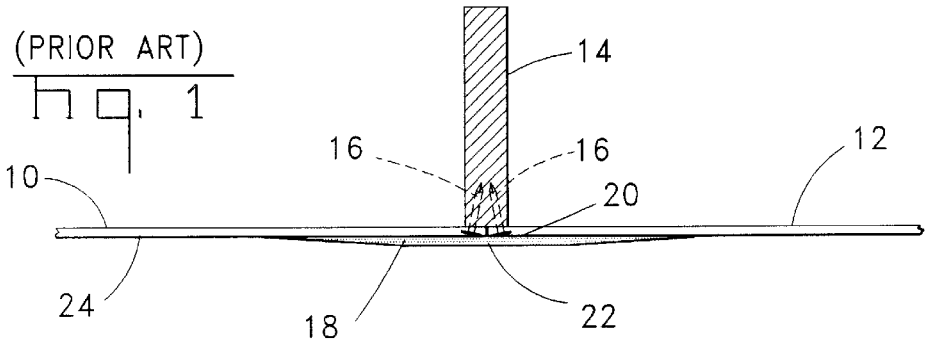
(PRIOR ART) Fig. 1
FIG. 1 is a cross-sectional view through a construction beam showing a typical prior art butt joint.
Figure 16:
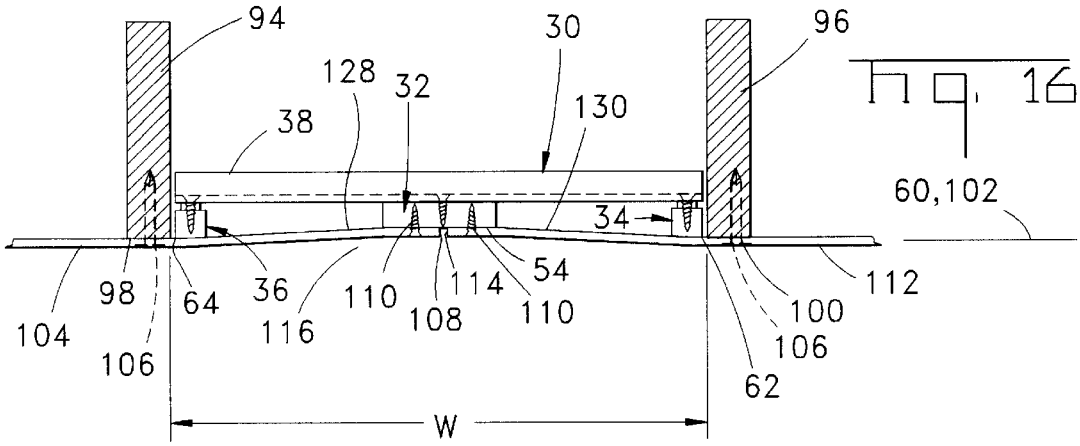
FIGS. 14 through 17 are views similar to that of FIG. 13 showing installation of the butt joint hanger device of FIG. 2 and the wallboard.
Figure 17:
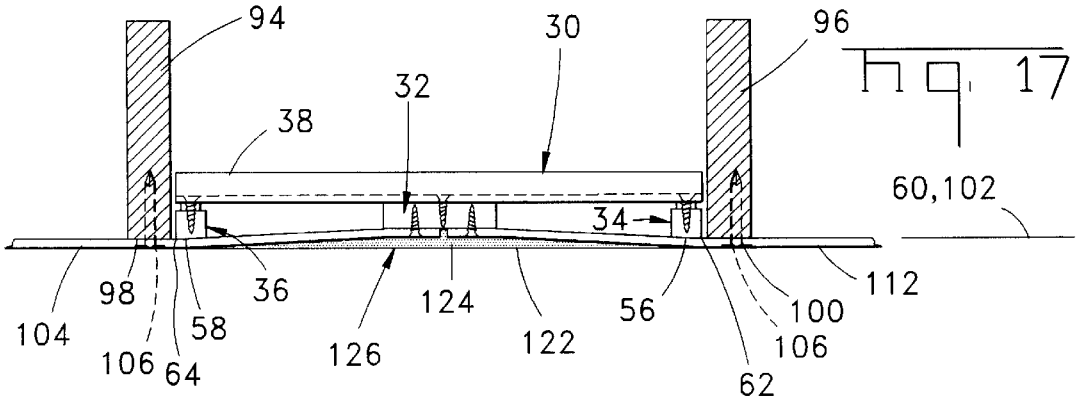
Figure 6:
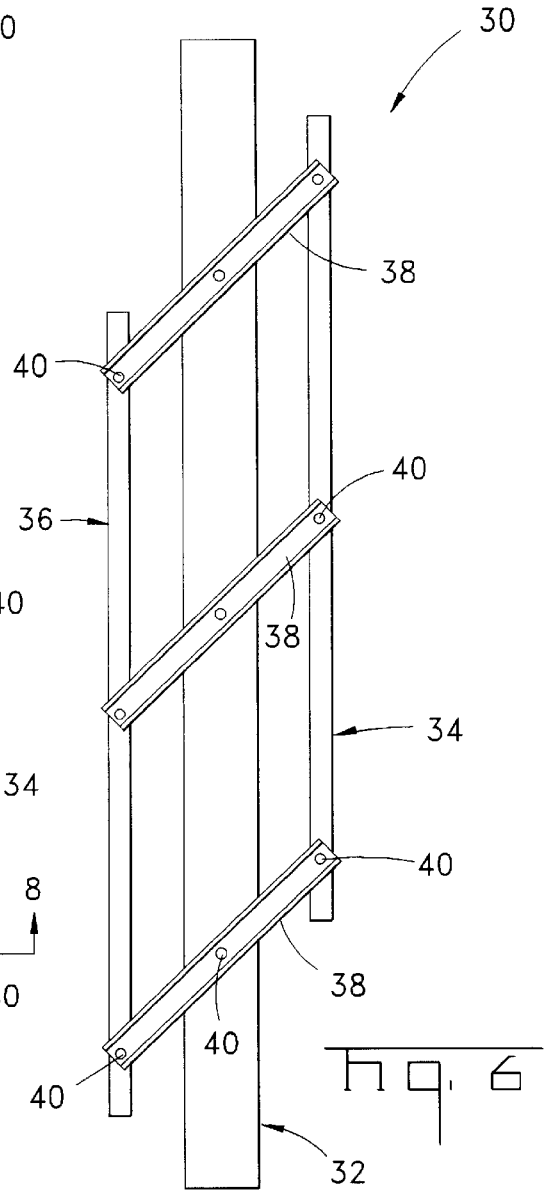
FIG. 6 is a view similar to that of FIG. 4 showing the butt joint hanger device in a partially closed position.
Figure 13:
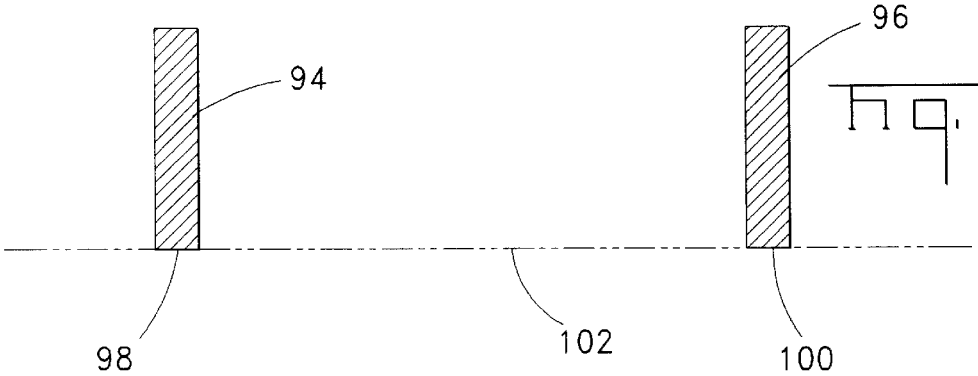
FIG. 13 is a cross-sectional view of two spaced construction beams prior to installation of wallboard.
Figure 14:
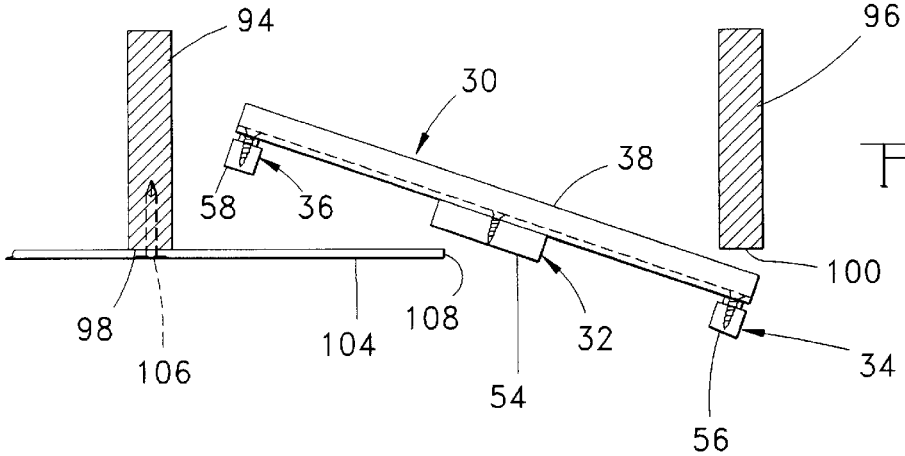
Figure 15:
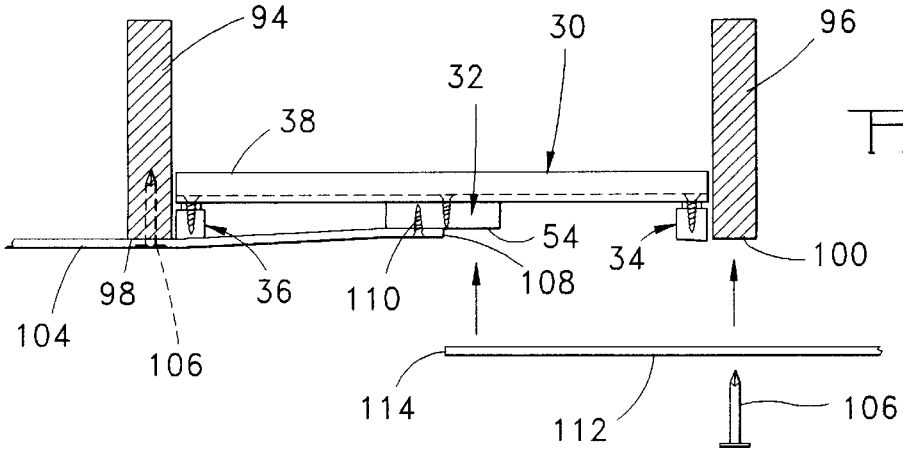

The operation of the butt joint hanger 30 will now be described with reference to FIGS. 13 through 17. A pair of typical adjacent construction beams 94 and 96 are shown in FIG. 13. The two construction beams 94 and 96 include nailing surfaces 98 and 100, respectively, which define a plane 102. A sheet of wallboard 104 is attached to the surface 98 of the beam 94 and to adjacent beams that are not shown by means of nails 106 in the usual manner. Note that the butt end 108 is positioned approximate equidistance from each beam 94 and 96. The butt joint hanger 30, in its open position, is inserted into the opening between the butt end 108 and the beam 96, as shown in FIG. 14. The butt joint hanger 30 is arranged so that the first rail 34 is resting upon the side of the wallboard 104 facing the beam 94 and is closely adjacent the beam 94 and the second rail 36 is closely adjacent the beam 96, as shown in FIG. 15. The outer surfaces of the first and second rails 34 and 36 are spaced to easily fit between the two construction beams 94 and 96. In cases where the construction beams 94 and 96 are spaced closer than the standard 16 or 24 inches on centers, the first and second rails 34 and 36 can be pivoted to a partially closed position, shown in FIG. 6, so that the outer surfaces of the first and second rails easily fit between the two construction beams. The wallboard 104 is then attached to the mounting surface 54 of the central rail 32 by means of closely spaced drywall screws 110, as shown in FIG. 15. If desired, glue may be applied between the surface of the wallboard 104 and the surface 54 along its entire length, prior to attachment. A second sheet of wallboard 112 is then positioned with its butt end 114 in alignment with the butt end 108, as shown in FIG. 15, and attached to the surface 100 of the beam 96 and to adjacent beams that are not shown by means of nails 106 in the usual manner. The wallboard 112 is then attached to the mounting surface 54 of the central rail 32 by means of closely spaced drywall screws 110, as shown in FIG. 16. And, if desired, glue may be applied between the wallboard 112 and the surface 54 along its entire length. Note that, as shown in FIG. 16, the butt ends 108 and 114 are pulled toward the mounting surface 54, out of the plane 102 thereby forming a depression or beveled area 116 in the two sheets of wallboard that extends across the width W, indicated in FIG. 16, for the entire length of the butt ends 108 and 114. The width W extends from the edge 62 to the edge 64 so that the beveling deflection of the wallboard begins at these edges and smoothly progresses toward the butt ends 108 and 114 to produce the smooth, wide but shallow depression area 116. The depression area 116 is then filled with plaster and a layer of embedded paper tape, in the usual manner, to produce a flat, smooth butt joint 126, as shown in FIG. 17.

It will be appreciated that the butt joint hanger 30 is in no way attached to the construction beams 94 and 96. When the screws 110 draw the butt ends 108 and 114 toward the mounting surface 54 to the position shown in FIG. 16, the abutting surfaces 56 and 58 are forced against the upper surfaces of the two sheets of wallboard 104 and 112, respectively. Since the two sheets of wallboard 106 and 112 are securely attached to the nailing surfaces 98 and 100, respectively, the edges 62 and 64 defining the plane 60 are maintained flush with the nailing surfaces 98 and 100. That is, the two planes 60 and 102 remain coplanar and the surfaces 128 and 130 of the sheets of wallboard 104 and 112 near the butt ends are pulled away from the plane 102 and into engagement with the mounting surface 54, as shown in FIG. 16. All standard thicknesses of the sheets of wallboard 104 and 112 may be used with the butt joint hanger 30. Since the butt joint hanger 30 is not attached to the construction beams, it is easily used in either metal or wood beam construction. Additionally, in circumstances where the butt ends of the wallboard to be joined are less than 48 inches long, the central rail 32 and first and second rails 34 and 36 can be easily cut to shorten the butt joint hanger 30 as desired, including removal of one or more of the U-channels 38.

A second embodiment of the present invention is shown in FIGS. 18 and 19 and identified as butt joint hanger 140. The butt joint hanger 140 is an elongated member 142 having a length similar to the length of the central rail 32 and a longitudinal axis 144. The hanger includes outer edges 146 and 148 that define the plane 60 in a manner similar to the edges 62 and 64 of the hanger 30. The elongated member 142 includes first and second major surfaces 150 and 152, respectively, that extend from the outer edges 146 and 148, respectively, to the axis 144, while diverging away from the plane 60. The distance between this apex, or the axis 144, formed by the two diverging major surfaces and the plane 60 is indicated as D in FIG. 19 and is similar to the distance D in FIG. 8, which is between about 0.050 inch and about 0.120 inch. First and second abutting surfaces 154 and 156, respectively, extend adjacent to and along the length of the two edges 146 and 148, respectively, as shown in FIG. 19. That is, the first and second abutting surfaces 154 and 156 are portions of the first and second major surfaces 150 and 152, adjacent the edges 146 and 148, respectively. A joint mounting surface extends on both sides of the longitudinal axis 144, a first portion 158 being a portion of the first major surface 150 and a second portion 160 being a portion of the second major surface 152. The first and second portions 158 and 160 of the joint mounting surface are shown slightly angled since they are continuations of the first and second diverging major surfaces 150 and 152, respectively, as shown in FIG. 19. However, the two portions 158 and 160 may be arranged differently, for example, to form a single flat mounting surface that extends on opposite sides of the longitudinal axis 144. The elongated member 142 can be manufactured using a process similar to that used in the making of plywood or it can be made of wood chips or wood particles with a binder such as resin and formed in a press. The length and thickness of the elongated member 142 should be similar to the length and thickness of the central elongated rail 32 of the hanger 30. The butt joint hanger 140 is installed between the two construction beams 94 and 96, as shown in FIG. 20, in a manner similar to that for the butt joint hanger 30, as described above. That is, the piece 104 of wallboard is attached to the construction beam 94 by means of the nails 106 with its butt end 108 approximately centered between the two beams 94 and 96. The butt joint hanger 140 is then positioned so that its first abutting surface 154 and first mounting surface 158 are against the surface 128 of the wallboard and the longitudinal axis 144 is closely adjacent the butt end 108. The wallboard is then attached to the mounting surface 158 by means of glue, if desired, and drywall screws 110, in the usual manner. The second piece 112 of wallboard is then attached to the construction beam 96 by means of the nails 106 so that its butt end 114 is adjacent the butt end 108, and attached to the mounting surface 160 by means of glue, if desired, and drywall screws 110. This tends to pull the two butt ends of the two pieces of wallboard 104 and 112 away from the normal plane of the drywall surface thereby forming the depression 116, in a manner similar to that of the butt joint hanger 30 as shown in FIG. 16. The depression can than be filled with plaster and a layer of embedded paper tape, in the usual manner, to complete the butt joint and form a smooth, flat joint.

A variation of the second embodiment butt joint hanger 140 is shown in FIG. 21 and identified as butt joint hanger 166 with an elongated member 168 having a length and thickness similar to that of the elongated member 142. In this example the first and second major surfaces 150 and 152 form a smooth continuous curve from the outer edge 146, through the longitudinal axis 144, to the outer edge 148. In this example the first abutting surface 154 and the first portion 158 of the mounting surface are portions of the first major surface 150. Similarly, the second abutting surface 156 and the second portion 160 of the mounting surface are portions of the second major surface 152. This butt joint hanger 166 is installed and will function in a manner similar to that of the butt joint hanger 140 as described above.

A second variation of the second embodiment butt joint hanger 140 is shown in FIG. 22 and identified as butt joint hanger 176 with an elongated member 178 having a length and thickness similar to that of the elongated member 142. In this example the first and second major surfaces 150 and 152 form a single flat surface extending on both sides of the longitudinal axis 144. As with the elongated member 142, the first and second portions 158 and 160 of the mounting surface are on opposite sides of the axis 144 and are portions of the first and second major surfaces 150 and 152, respectively. The first and second abutting surfaces 154 and 156, however, are formed on first and second elongated rails 180 and 182, respectively, that are attached to the major surfaces 150 and 152 near their respective edges, as shown in FIG. 22. It will be appreciated by those skilled in the art that the two rails 180 and 182 and the member 178 may be formed as a single piece of unitary construction, such structure considered fully within the teachings of the present invention. This butt joint hanger 176 will be installed and will function in a manner similar to that of the butt joint hanger 140.

An important advantage of the present invention is that the butt joint hanger is easily installed, by the wallboard installer, without the need to cut the hanger to fit between the two construction beams and does not require attachment to the beams in any way. Further, the device does not interfere with the normal attachment of the wallboard to the construction beams, yet will support the edges of the two pieces of wallboard being joined and will provide a glue base along the entire length of the butt joint. The butt joint hanger provides the desired beveled effect needed to produce a smooth, flat butt joint.

It is claimed:

1. A butt joint hanger device adapted for use between two construction beams for connecting adjacent ends of two pieces of wallboard together to form a butt joint having a first length, comprising:

(a) first and second parallel elongated rails having opposite outer surfaces, said first and second rails on opposite sides of a centerline so that said opposite outer surfaces are on a desired spacing;

(b) a central elongated rail having a second length and a longitudinal axis coincident with said centerline and disposed between said first and second rails;

(c) at least one lateral member secured at attachment points to said first and second rails and said central rail for holding said two opposite outer surfaces on said desired spacing;

wherein said first and second rails have first and second abutting surfaces, respectively, opposite said lateral members, opposite outer edges of said first and second abutting surfaces defining a first plane, said central rail including a mounting surface opposite said lateral members and being spaced from said plane.

2. The butt joint hanger according to claim 1 wherein said two construction beams each have a respective wallboard mounting surface lying in a second plane, each piece of said two pieces of wallboard being secured to a respective one of said wallboard mounting surfaces, said butt joint hanger adapted so that when installed between said two construction beams, said first plane and said second plane coincide and said mounting surface is spaced from said second plane.

3. The butt joint hanger according to claim 1 wherein said desired spacing is chosen so that when said hanger device is installed between said two construction beams, each said first and second rail is in close proximity to a respective said construction beam.

4. The butt joint hanger according to claim 1 wherein said butt joint hanger device is adapted to be supported only by said two pieces of wallboard.

5. The butt joint hanger according to claim 1 wherein said second length is about as long as said first length.

6. The butt joint hanger according to claim 1 wherein said second length is greater than said first length.

7. The butt joint hanger according to claim 1 wherein said attachment points are pivotal attachments so that said lateral members and said first, second, and central, rails are pivotally movable for altering said desired spacing of said two opposite outer surfaces.

8. The butt joint hanger according to claim 1 wherein said first and second abutting surfaces diverge from said first plane in a direction toward said axis so that when said hanger device is installed between said two construction beams, each of said edges defining said first plane are adjacent a respective construction beam.

9. The butt joint hanger according to claim 8 wherein each of said attachment points to said first and second rails includes a spacer member between said lateral member and a respective first and second rail.

10. A butt joint hanger device adapted to be installed between two construction beams for connecting adjacent ends of two pieces of wallboard together to form a butt joint between said two construction beams having a first length, said two construction beams each having a respective wallboard nailing surface lying in a second plane, each piece of said two pieces of wallboard being secured to a respective one of said wallboard nailing surfaces, said device comprising:

(a) one or more lateral members each having a first surface;

(b) a central elongated rail having a longitudinal axis and a joint mounting surface of a second length, said central elongated rail having a side opposite said joint mounting surface attached to said first surface of said one or more lateral members; and (c) each of said one or more lateral members having first and second abutting members attached to said first surface and extending therefrom on opposite sides of said central elongated rail, each of said first and second abutting members having an abutting surface, opposite outer edges of said abutting surfaces being arranged in a first plane, wherein said central elongated member is spaced from said second plane.

11. The butt joint hanger according to claim 10 wherein said central elongated rail is attached to said first surfaces of said one or more lateral members by means of pivotal attachments so that the spacing between said first and second abutting members with respect to said axis can be adjusted to be received between said two construction beams of different spacings.

12. The butt joint hanger according to claim 11 wherein said one or more lateral members are at least two lateral members and wherein each of said abutting members is attached to a said first surface of a respective said at least two lateral members by means of a pivotal attachment.

13. The butt joint hanger according to claim 12 wherein each of said pivotal attachments to said first and second abutting members includes a spacer member between said one or more lateral members and a respective first and second abutting member.

14. The butt joint hanger according to claim 10 adapted so that when installed between said two construction beams, said first and second planes coincide and said joint mounting surface is between said second plane and said first surface of said lateral members.

15. The butt joint hanger according to claim 13 wherein said hanger is adapted to be spaced from said two construction beams.

16. The butt joint hanger according to claim 10 wherein said first abutting members of some of said lateral members are mutually attached to form a continuous elongated first side rail and wherein said second abutting members of some of said lateral members are mutually attached to form a continuous elongated second side rail.

17. The butt joint hanger according to claim 10 wherein said abutting surfaces of said first and second abutting members diverge from said first plane in a direction toward said axis so that when said hanger device is installed between said two construction beams, each of said edges defining said plane are adjacent a respective construction beam.

18. The butt joint hanger according to claim 10 adapted to be supported only by said two pieces of wallboard.

19. A butt joint hanger device, in combination with two pieces of wallboard, said device, installed between two construction beams connecting adjacent ends of two pieces of wallboard together forming a butt joint between said two construction beams having a first length, said two construction beams each having a respective wallboard nailing surface lying in a second plane, each piece of said two pieces of wallboard being secured to a respective one of said wallboard nailing surfaces, said device comprising an elongated rail having a second length, a longitudinal axis, and a joint mounting surface extending on opposite sides of said longitudinal axis and first and second abutting surfaces on opposite sides of said joint mounting surface, wherein said first and second abutting surfaces include first and second opposite outer edges, respectively, that define a first plane so that said first and second planes coincide and said joint mounting surface is spaced from said first plane, wherein said device engages only a single side of each of said two pieces of wallboard.

20. The combination according to claim 19, said devices includes first and second outer elongated members attached to opposite sides of said elongated rail, and wherein said first abutting surface is a surface on said first outer elongated member and said second abutting surface is a surface on said second elongated member.

21. The combination according to claim 20 wherein said abutting surfaces of said first and second outer elongated members diverge away from said first plane in a direction toward said axis.

22. The combination according to claim 21, said devices being supported only by said two pieces of wallboard.

23. The combination according to claim 19 wherein said joint mounting surface comprises a first mounting surface extending from said first abutting surface to said longitudinal axis and a second mounting surface extending from said second abutting surface to said axis.

24. The combination according to claim 23 wherein said first and second mounting surfaces diverge away from said first plane toward said longitudinal axis.

25. The combination according to claim 24 wherein said first mounting surface is a smooth continuation of said first abutting surface and said second mounting surface is a smooth continuation of said second abutting surface.

26. The combination according to claim 25, said device being supported only by said two pieces of wallboard.

27. The combination according to claim 19, wherein said device includes an arcuate surface extending from said first outer edge, through said longitudinal axis, to said second outer edge, said first and second abutting surfaces and said joint mounting surface being portions of said arcuate surface.

* * * * *